US007296679B2

(12) United States Patent
Lam

(10) Patent No.: US 7,296,679 B2
(45) Date of Patent: Nov. 20, 2007

(54) MULTI-PURPOSE FIXING INSERT FOR TOY CONTAINERS AND METHOD OF PACKAGING

(75) Inventor: Terry Lam, Kowloon (HK)

(73) Assignee: Funrise Toys, Ltd., Kowloon (HK)

( * ) Notice: Subject to any disclaimer, the term of this patent is extended or adjusted under 35 U.S.C. 154(b) by 248 days.

(21) Appl. No.: 11/135,917

(22) Filed: May 23, 2005

(65) Prior Publication Data

US 2005/0269235 A1 Dec. 8, 2005

Related U.S. Application Data

(60) Provisional application No. 60/574,360, filed on May 24, 2004.

(51) Int. Cl.
*B65D 85/68* (2006.01)
*B65D 25/54* (2006.01)

(52) U.S. Cl. ..... 206/477; 206/335; 206/775

(58) Field of Classification Search ..... 206/335, 206/477–483, 775–783, 488–489
See application file for complete search history.

(56) References Cited

U.S. PATENT DOCUMENTS 3,481,453 A * 12/1969 Beichler et al. ..... 206/778
4,185,739 A * 1/1980 Wilford ..... 206/477
4,261,466 A * 4/1981 Wilford ..... 206/335
4,925,025 A * 5/1990 Anten et al. ..... 206/335
5,411,138 A * 5/1995 Klawiter ..... 206/335

* cited by examiner

*Primary Examiner*—Bryon P. Gehman
(74) *Attorney, Agent, or Firm*—Lewis Anten; Ying Chen

(57) ABSTRACT

A multi-purpose insert designed to be used in conjunction with a conventional toy container or box for packaging, shipping and displaying a toy item. The insert includes a base piece, a cover piece and a holding piece, as well as a locking mechanism. The base piece has a main section with a raised platform and two end sections that are hingeably connected to the main section so that they can be folded up in a right angle relative to the main section. The insert also includes a cover piece which is placed over the toy item placed on the main section of the base piece, and a holder piece placed above the cover piece for keeping the two end sections in the upright position for retaining the toy item for packaging and shipping purposes. When the holding piece is removed, the two end sections of the base piece can be folded down for displaying the toy item on the raised platform of the main section of the base piece.

9 Claims, 2 Drawing Sheets

MULTI-PURPOSE FIXING INSERT FOR TOY CONTAINERS AND METHOD OF PACKAGING

This is a regular patent application based on U.S. Provisional Patent Application No. 60/574,360 filed on May 24, 2004.

BACKGROUND OF THE INVENTION

1. Field of the Invention

The present invention generally relates to the field of packaging and shipping containers, and more particularly relates to the field of packaging and shipping containers used for toy merchandise.

2. Description of the Related Art

Packaging and shipping containers are widely used in the toy industry. Conventional packaging and shipping containers for toys typically consist of preformed boxes made of plastic or cardboard materials.

There are numerous problems associated with shipping toy merchandise that are fragile. The most obvious problem is that during shipment the product tends to move within the packaging container which often causes damage to the product. Another significant problem is the damage to the external container which also often results damage to the product inside of the container.

The above problems have traditionally been addressed by surrounding the product being shipped with fabric, foam pellets or formed polystyrene. In addition, heavy damage resistant packaging, such as wood or thick cardboard has also been employed.

However, for most toy merchandise, simple and light weight packaging structures are still mostly desired. In addition, toy merchandise are often displayed in shop shelves or by private collectors where a display platform is often desirable.

Therefore, there exists a need to provide an insert of simple and lightweight construction that can be used in regular cardboard containers for packaging and shipping toy merchandise, which insert can also be used for easy handling and displaying of the toy merchandise once they are removed from the containers.

SUMMARY OF THE PRESENT INVENTION

The present invention discloses a multi-purpose insert for toy containers.

In a preferred embodiments of the present invention, the multi-purpose insert is designed to be used in conjunction with a conventional toy container or box for packaging, shipping and displaying a toy item. The insert includes a base piece, a cover piece and a holding piece. The base piece has a main section and two end sections. The main section of the base piece has a raised platform surrounded by beveled sidewalls. The two end sections of the base piece each also has a raised center portion surrounded by beveled sidewalls.

The main section and two end sections of the base piece are hingeably connected, where the two end sections can be folded up in a right angle position relative to the main section with the toy item placed on the main section of the base piece. The insert also includes a transparent cover piece which is placed over the toy item, and a holder piece for keeping the two end sections of the base piece at the upright position for retaining the toy item for packaging and shipping purposes.

When removed from the toy container, the present invention insert can also be opened with the holding and cover pieces removed and the two end sections of the base piece folded down in flat alignment with the main section of the base piece for displaying the toy item on the raised platform of the main section of the base piece.

The present invention multi-purpose insert also includes a locking mechanism which secures the toy item in position on the platform of the base piece while it is being packaged, shipped or displayed.

The present invention multi-purpose toy container insert has a simple, easy and durable construction and can be made of plastic, cardboard or other suitable materials.

OBJECTS OF THE PRESENT INVENTION

It is an object of the present invention to provide a novel, unique and improved device for packaging toy merchandise.

It is also an object of the present invention to provide a novel, unique and improved device for shipping toy merchandise.

It is another object of the present invention to provide a novel, unique and improved device for displaying toy merchandise.

It is also another object of the present invention to provide a novel, unique and improved packaging, shipping and shipping combination device for toy merchandise.

It is yet another object of the present invention to provide a novel, unique and improved packaging insert that can be used in conjunction with conventional toy boxes or containers.

It is still another object of the present invention to provide a novel, unique and improved shipping insert that can be user in conjunction with conventional toy boxes or containers.

It is an additional object of the present invention to provide a novel, unique and improved insert for conventional toy boxes or containers that can be used for displaying toy merchandise after a toy merchandise is removed from its container or box.

It is also an additional object of the present invention to provide a novel, unique and improved insert for conventional toy boxes or containers that can serve multiple purposes of packaging, shipping and displaying toy merchandise.

It is a further object of the present invention to provide a novel, unique and improved multi-purpose insert for conventional toy boxes or containers that has a lightweight construction.

It is also a further object of the present invention to provide a novel, unique and improved multi-purpose insert for conventional toy boxes or containers that has a simple and easy construction.

It is still a further object of the present invention to provide a novel, unique and improved multi-purpose insert for conventional toy boxes or containers that is made of durable, lightweight and fire-retardant materials.

These and other objects of the present invention will become apparent from a review of the accompanying drawings and the detailed description of the drawings.

DETAILED DESCRIPTION OF THE PREFERRED EMBODIMENTS

Figure 1:
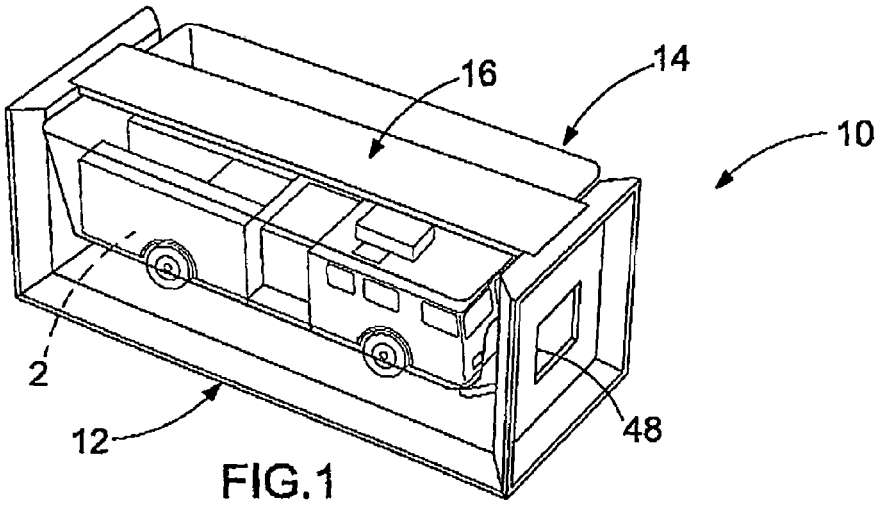
FIG. 1 is a prospective view of one of the preferred embodiments of the present invention multi-purpose insert for a toy merchandise to be used in conjunction with a conventional toy container or box.
Figure 3:
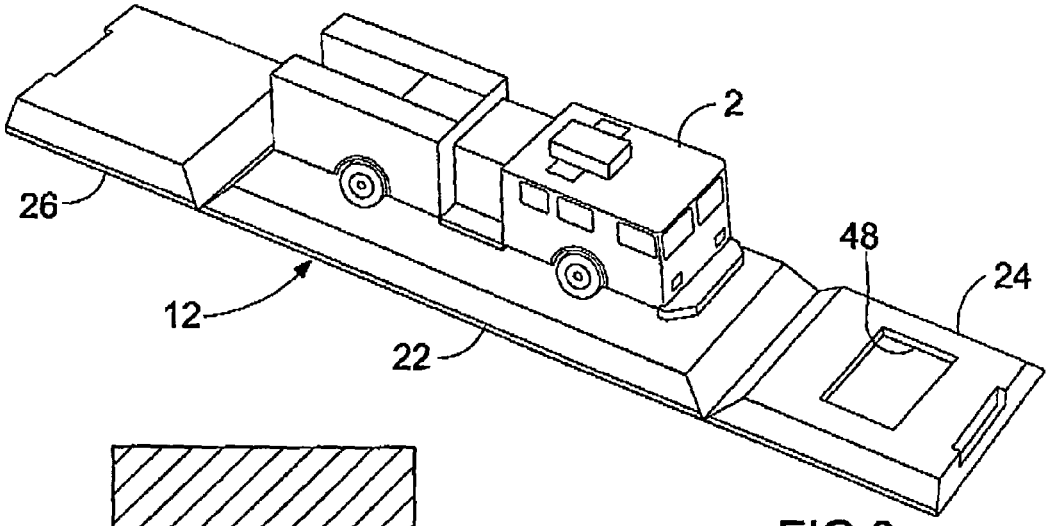
FIG. 3 is a prospective view showing the present invention multi-purpose insert used for displaying a toy merchandise.
Figure 2:
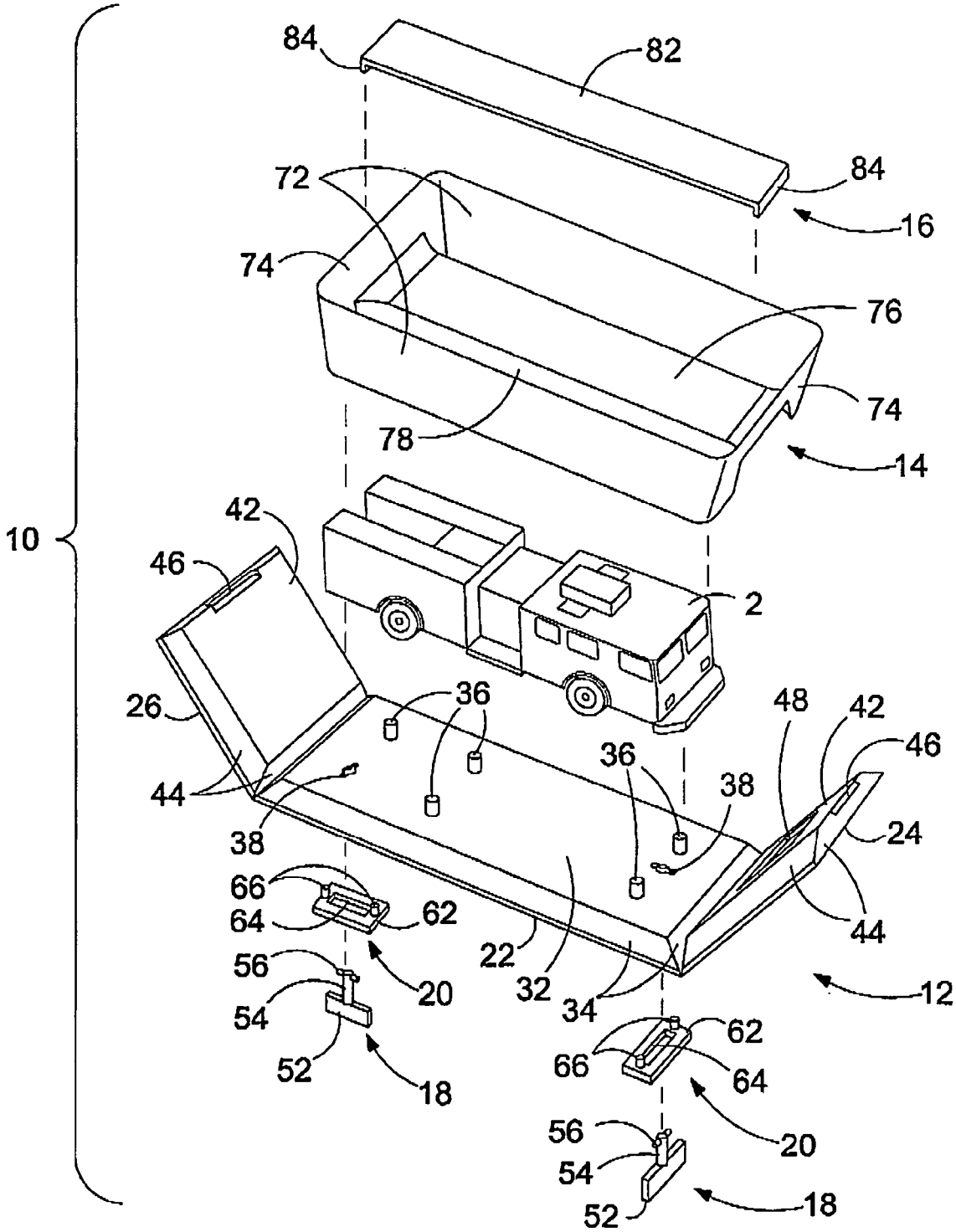
FIG. 2 is an exploded prospective view showing the component parts of the preferred embodiment of the present invention multi-purpose insert shown in FIG. 1.

Referring to FIGS. 1 through 3, one of the preferred embodiments of the present invention multi-purpose insert to be used in conjunction with a conventional toy container or box for packaging, shipping and displaying a toy merchandise is shown and generally referred to by the numeral 10.

FIG. 1 shows a toy item 2 (in this example a fire truck) packaged inside the insert 10 in a generally rectangular shaped configuration for insertion into a similarly shaped cardboard container or box (not shown) for packaging and shipping purposes, FIG. 2 shows the insert 10 opened up and unpacked to show the component parts of the insert 10, and FIG. 3 shows the insert 10 used as a base for displaying and exhibition purposes.

The preferred embodiment of the present invention insert 10 includes a base piece 12, a cover piece 14 and a holding piece 16. The base piece 12 has a main section 22, and two end sections 24 and 26 hingeably connected to the opposite ends of the main section 22, respectively.

The main section 22 of the base piece 12 has a raised platform 32 surrounded by beveled sidewalls 34. On the platform 32 there are multiple pegs 36 strategically located for securing the position of the toy item 2 on the platform 32, and one or more key holes 38 which use will be described below.

The two end sections 24 and 26 of the base piece 12 each also has a raised center portion 42 which, when the main section 22 and the end sections 24 and 26 are all laid flat (as shown in FIG. 3), has the same height as the platform 32 of the main section 22 of the base piece 12, and which is surrounded by beveled sidewalls 44.

The beveled sidewalls 34 at the opposite ends of the main section 22 and the adjacent beveled sidewalls 44 of the end sections 24 and 26, respectively, of the base piece 12, are hingeably connected such that the two end sections 24 and 26 can be folded up in a right angle relative to the main section 22 for retaining and protecting the front and rear ends of the toy item 2 for packaging and shipping purposes, or alternatively be folded down in flat alignment with the main section 22 of the base piece 12 to serve as a raised display base for the purpose of exhibiting the toy item 2 (as shown in FIG. 3).

One or both of the end sections 24 and 26 may be provided with an opening 48 which can serve the purpose of accommodating extended portions of the toy item 2 (such as the hood or front bumper of the fire truck shown in this example) and can also serve the purpose of allowing the features of the toy item 2 be viewed while contained in the container which optionally may have a transparent window at corresponding position.

The present invention insert 12 also includes a locking mechanism for locking the toy piece 2 in position while it is being packaged or shipped inside a container or box, or displayed on the base piece 12. The locking mechanism includes one or more keys 18 and a matching number of key holders 20.

Figure 4:
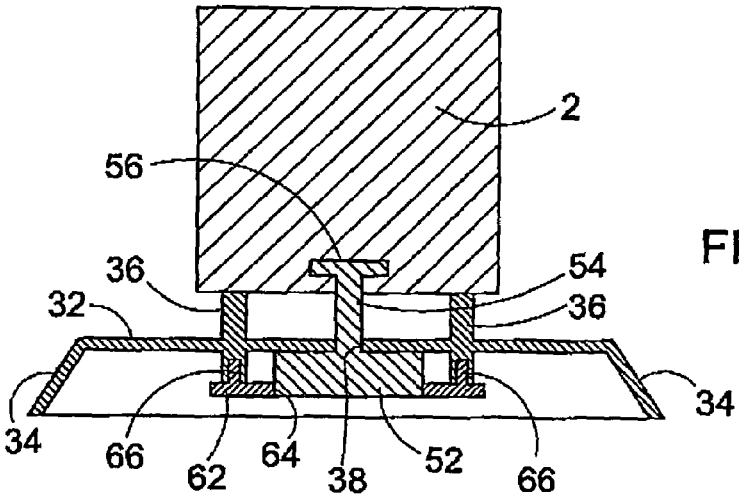
FIG. 4 is a cross-sectional view showing the locking mechanism of the preferred embodiment of the present invention multi-purpose insert for toy containers.

As shown in FIGS. 2 and 4, each locking key 18 has a knob 52, a stem 54 and a key pin 56. Each key holders 20 has a plate 62 with a key knob slot 64 and a pair of positioning pegs 66. The size of the plate 62 and the locations of the key knob slot 64 and the pegs 66 of the key holder 20 are made to match the locations of the pegs 36 and key holes 38 of the main section 22 of the base piece 12. The size of the key knob slot 64 also matches the key knob 52 of the locking key 18.

As the key pin 56 and stem 54 of the locking key 18 is inserted through the key knob slot 64 of the key holder 20 and the pegs 66 of the key holder 20 are inserted into the small holes underneath the corresponding pegs 38 of the main section 22 of the base piece 12, the key pin 52 and stem 54 of the locking key 18 is further inserted through the key hole 38 of the main section 22 of the base piece 12 and finally inserted into a bottom lock of the toy item 2.

The key 18 is designed such that by turning the key knob 52 of the locking key 18 to a direction aligned with the key knob slot 64 of the key holder 20, the key pin 56 is locked with the bottom lock of the toy item 2, so that the key knob 52 of the locking key 18 can be inserted in the key knob slot 64 of the key holder 20 which prevents further turning of the key 18 so that the toy item 2 remains locked by the key 18 while being packaged, shipped or displayed.

As shown in FIGS. 1 and 2, the cover piece 14 f the present invention insert 10 is placed over the toy item 2 when the toy item 2 is packaged. The cover piece 14 has two opposite sidewalls 72 and two opposite end walls 74 all integrally formed and connected together with a top cover 76. The whole cover piece may be made of transparent plastic material.

The holder piece 16 has an elongated body 82 with two opposite end hooks 84. As the cover piece 14 is placed over the toy item 2 and the two end sections 24 and 26 of the base piece 12 folded up, the holder piece 16 is placed above the cover piece 14 with the two end hooks 84 of the holder piece inserted into and engaged with respectively the slot openings 46 at the beveled sidewalls 44 at the respective distal far end of the end section 24 and 26 of the base piece 12 to thereby prevent the two end sections 24 and 26 from unfolding such that they are kept at an upright angle relative to the main section 22 of the base piece 12 to retain the toy item 2 as shown in FIG. 1 for packaging and shipping purposes.

The present invention insert 12 serves many important purposes for packaging, shipping and displaying the toy item 2. As shown in FIG. 1, when the insert 12 is configured to retain the toy item 2, it provides impact protection on all sides of the toy item 2. It also provides a locking mechanism to secure the toy item 2 in position so it cannot move around inside a packaging container or box while being handled or shipped. On the other hand, when the insert 12 is opened as shown in FIG. 3, it serves as a raised exhibition platform for displaying the toy item 2.

It is appreciated that while an insert that is suitable to be used in conjunction with a generally rectangular shaped packaging container or box is described hereinabove, the present invention multi-purpose insert may be configured to suit packaging containers or boxes of other configurations, without departing from the scope and spirit of the present invention.

The method used in preparing the package comprises the steps of aligning the openings in the product and in the packaging so that the keys can be inserted through the aligned openings and the key can then be turned by the handle so as to fix the product to the packaging. The packaging can be used to substantially cover the entire product or only a portion of the product.

In the preferred embodiment at least one slot formed in the product is oriented parallel to the axis of the product and at least one second slot is at a different orientation, preferably 90 degrees to the first slot.

While the present invention has been described in detail with regards to the preferred embodiments, it is appreciated that other variations of the present invention may be devised which do not depart from the inventive concept of the present invention.

What is claimed is:

1. A combination package and product comprising:

a product having a first opening;

packaging material disposed adjacent said product and having a first opening in alignment with said first opening in said product;

a key having a first end, a second end and an intermediate shaft, the first end configured to be insertable through said first opening in said packaging material and into said first opening in said product, the key capable of being rotated whereby said first end engages an interior of said product, the second end of said key having a handle portion and being accessible from an outer side of the packaging material away from the product so as to rotate the key thereby fixing said product to said packaging material; and a key holder disposed on the outer side of the packaging material, the key holder having a plate with a slot for receiving the handle portion of the key and a positioning peg, wherein the packaging material further includes a peg receiving hole for receiving the positioning peg.

2. The combination package and product of claim 1, further comprising a second opening in said product and a second opening in said packaging material.

3. The combination package and product of claim 2, wherein the first opening in the product is elongated in a first direction and the second opening in the product is elongated in a second direction different from the first direction.

4. The combination package and product of claim 1 wherein the first end of the key is in the form of a T and the first opening in said product has an elongated shape.

5. The combination package and product of claim 1 wherein said packaging material substantially encloses said product.

6. A method for packaging a product with a packaging material, said product having an opening, said packaging material having an opening, the method comprising:

aligning the opening in the packaging material with the opening in said product;

placing a key through said opening in said packaging material into said opening in said product;

rotating the key to engage an interior of the opening of the product, whereby said key fixes said packaging material to said product; and placing a key holder on an outer side of the packaging material to engage the key to prevent the key from turning further.

7. The method of claim 6 wherein said packaging material substantially encloses said product.

8. The method of claim 6 wherein said key has a T-shaped portion at one end and a handle portion at another end and wherein said opening in said product has an elongated shape.

9. The method of claim 8, wherein the key holder has a plate with a slot and a positioning peg, wherein the packaging material has a peg receiving hole, and wherein the key holder is placed by inserting the handle portion of the key into the slot of the key holder and inserting the positioning peg of the key holder into the peg receiving hole of the packaging material.

* * * * *